US009053875B2

(12) United States Patent
Tanaka

(10) Patent No.: US 9,053,875 B2
(45) Date of Patent: Jun. 9, 2015

(54) OPERATING MECHANISM

(75) Inventor: Naoki Tanaka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/119,731

(22) PCT Filed: Aug. 29, 2011

(86) PCT No.: PCT/JP2011/069423

§ 371 (c)(1),
(2), (4) Date: Nov. 22, 2013

(87) PCT Pub. No.: WO2012/169084

PCT Pub. Date: Dec. 13, 2012

(65) Prior Publication Data

US 2014/0091886 A1 Apr. 3, 2014

(30) Foreign Application Priority Data

Jun. 9, 2011 (JP) ..... 2011-129109

(51) Int. Cl.

*H01H 3/00* (2006.01)
*H01H 3/28* (2006.01)
*H01H 31/06* (2006.01)
(Continued)

(52) U.S. Cl.

CPC ..... *H01H 3/28* (2013.01); *H01H 31/06* (2013.01); *H01H 31/10* (2013.01); *H01H 31/003* (2013.01); *H01H 33/121* (2013.01); *H01H 89/00* (2013.01)

(58) Field of Classification Search

CPC ..... H01H 3/3015; H01H 3/42; H01H 15/102; H01H 15/105; H01H 9/06; H01H 31/06; H01H 31/10

USPC ..... 335/190

See application file for complete search history.

(56) References Cited

U.S. PATENT DOCUMENTS 3,652,815 A * 3/1972 Davies ..... 200/400
3,689,721 A * 9/1972 McGuffie ..... 200/400
(Continued)

FOREIGN PATENT DOCUMENTS

JP 9-097541 A 4/1997
JP 9-180594 A 7/1997
(Continued)

OTHER PUBLICATIONS

International Search Report (PCT/ISA/210) mailed on Nov. 29, 2011, by the Japanese Patent Office as the International Searching Authority for International Application No. PCT/JP2011/069423.
(Continued)

*Primary Examiner* — Shawki S Ismail
*Assistant Examiner* — Lisa Homza
(74) *Attorney, Agent, or Firm* — Buchanan Ingersoll & Rooney PC

(57) ABSTRACT

A shutter plate that is supported so as to be able to swing in both directions and covers both first and second operating parts, and a shutter mechanism that operates the shutter plate in one direction when the first operating part is to be exposed and in reverse direction when the second operating part is to be exposed are provided, wherein the shutter mechanism includes one pair of locking members for limiting or releasing the swing of the shutter plate.

8 Claims, 5 Drawing Sheets

(51) Int. Cl.

| | |
|---|---|
| ***H01H 31/10*** | (2006.01) |
| ***H01H 89/00*** | (2006.01) |
| *H01H 31/00* | (2006.01) |
| *H01H 33/12* | (2006.01) |

(56) References Cited

U.S. PATENT DOCUMENTS

| | | | | | |
|---|---|---|---|---|---|
| 3,697,709 | A | * | 10/1972 | Witkor | 200/48 R |
| 3,773,995 | A | * | 11/1973 | Davies | 200/400 |
| 3,898,420 | A | * | 8/1975 | Evans | 200/446 |
| 3,930,132 | A | * | 12/1975 | Harris | 200/38 R |
| 3,980,977 | A | * | 9/1976 | Evans | 335/76 |
| 4,001,740 | A | * | 1/1977 | MacLean | 335/73 |
| 4,190,755 | A | * | 2/1980 | Rogers | 200/334 |
| 4,206,329 | A | * | 6/1980 | Jarosz | 200/50.26 |
| 4,237,357 | A | * | 12/1980 | Opfer | 200/400 |
| 4,253,003 | A | * | 2/1981 | Evans et al. | 200/400 |
| 4,255,733 | A | * | 3/1981 | MacLean | 335/190 |
| 4,351,994 | A | * | 9/1982 | Evans et al. | 200/400 |
| 4,423,336 | A | * | 12/1983 | Iverson et al. | 307/64 |
| 4,668,926 | A | * | 5/1987 | Comtois et al. | 335/21 |
| 4,777,559 | A | * | 10/1988 | Bar et al. | 361/610 |
| 4,791,250 | A | * | 12/1988 | Yin | 200/17 R |
| 4,804,933 | A | * | 2/1989 | Becker et al. | 335/186 |
| 5,012,214 | A | * | 4/1991 | Faffart | 335/6 |
| 5,025,171 | A | * | 6/1991 | Fanta et al. | 307/150 |
| 5,034,584 | A | * | 7/1991 | Fanta et al. | 200/329 |
| 7,019,229 | B1 | * | 3/2006 | Weister et al. | 200/50.17 |
| 7,432,787 | B2 | * | 10/2008 | Muench et al. | 335/76 |
| 8,729,985 | B2 | * | 5/2014 | Bullock et al. | 335/120 |
| 8,809,705 | B2 | * | 8/2014 | Serrano et al. | 200/50.21 |
| 2013/0187732 | A1 | * | 7/2013 | Bullock et al. | 335/6 |
| 2013/0187733 | A1 | * | 7/2013 | Bullock et al. | 335/13 |

FOREIGN PATENT DOCUMENTS

| | | | |
|---|---|---|---|
| JP | 10-050179 | A | 2/1998 |
| JP | 2002-298707 | A | 10/2002 |
| JP | 2006-228673 | A | 8/2006 |

OTHER PUBLICATIONS

Japanese Notification of Reason for Refusal dated Sep. 9, 2014 issued in the corresponding Japanese Patent Application No. 2013-519341 and English language translation (5 pages).

Japanese Notification of Reasons for Refusal dated Feb. 24, 2015 issued in the corresponding Japanese Patent Application No. 2013-519341 and English translation (5 pages).

European Communication and Supplementary Search Report dated Feb. 12, 2015 issued in the corresponding European Patent Application No. 11867482.9-1808 (7 pages).

* cited by examiner

Fig. 5A Angle of rotation 8°
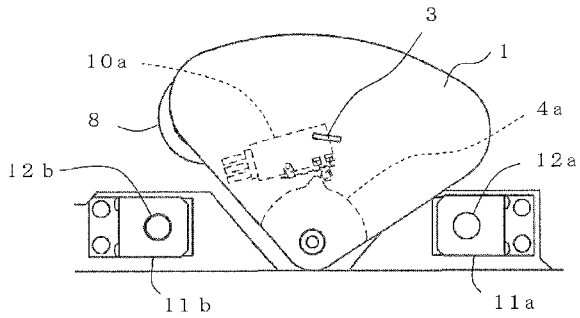
Fig. 5B Angle of rotation 20°
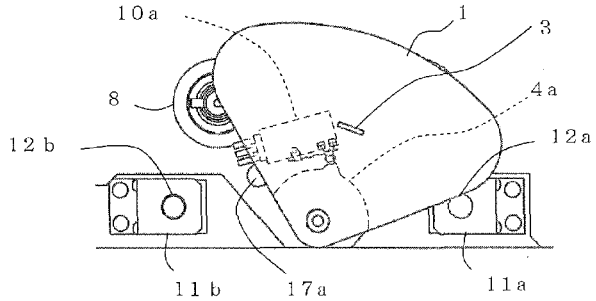
Fig. 5C Angle of rotation 30°
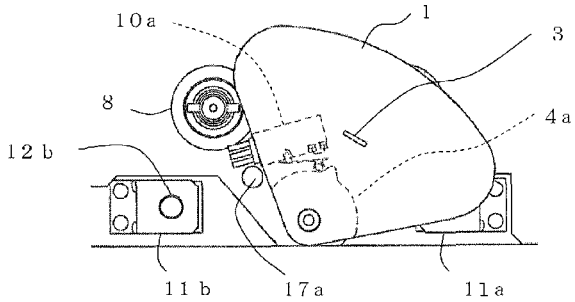
Fig. 5D Angle of rotation 30°
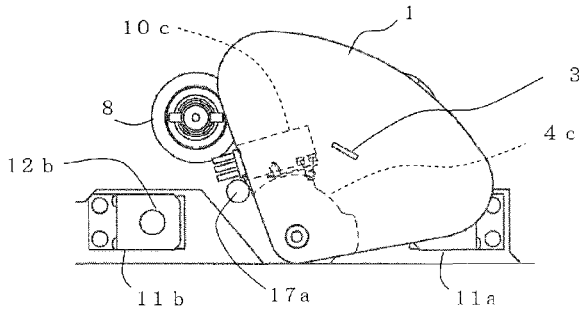

Fig. 6A Angle of rotation 8°
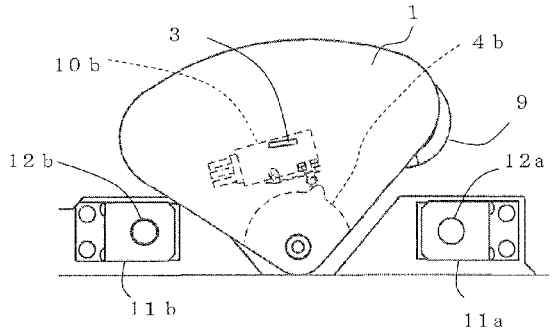
Fig. 6B Angle of rotation 20°
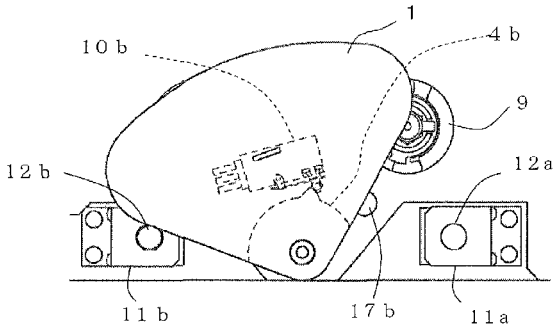
Fig. 6C Angle of rotation 30°
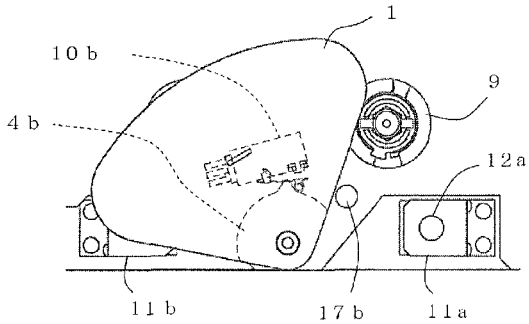
Fig. 6D Angle of rotation 30°
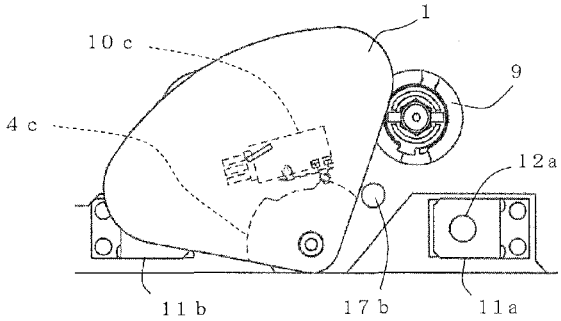

OPERATING MECHANISM

TECHNICAL FIELD

The present invention relates to an operating mechanism that is used for, for example, a three-position switch operating mechanism in which shutter functions of a disconnecting switch and an earthing switch are integrated into one shutter.

BACKGROUND ART

For example, in a conventional three-position switch operating mechanism, a shutter for switching the operation between a disconnecting switch operating part and an earthing switch operating part is rotated by rotating a rotation shaft of the shutter using a special shutter operating lever to be attached to the rotation shaft.

CITATION LIST

Patent Literature

PTL 1: JP-A-2006-228673

SUMMARY OF INVENTION

Technical Problem

In the conventional operating mechanism for operating the shutter as above, the special shutter operating lever is needed for switching the operation between the disconnecting switch operating part and the earthing switch operating part, and, specifically, the special shutter operating lever needs to be attached to the rotation shaft and then manually rotated. In order to do this, the shutter operating lever needs to be managed so as not to be lost. Furthermore, attaching the shutter operating lever to the rotation shaft is an extra work.

Solution to Problem

An operating mechanism in accordance with the invention includes: a shutter plate that is swingably supported by a swing shaft held by a mechanism body, covers both a first operating part and a second operating part placed in parallel to each other on the mechanism body; and a shutter mechanism that, in exposing the first operating part to operate the first operating part, swings the shutter plate in one direction and, in exposing the second operating part to operate the second operating part, swings the shutter plate in reverse direction, wherein the shutter mechanism includes one pair of locking members for limiting or releasing the swing of the shutter plate, wherein the shutter mechanism includes: first and second cams that move in conjunction with the shutter plate; and first and second limit switches that are opened and closed by the first and second cams, respectively, to control the protruding/retracting operation of one pair of plungers that can be protruded and retracted with respect to the shutter plate, wherein both the plungers normally limit the swing of the shutter plate to maintain the first operating part and the second operating part covered, and wherein, in operating the first operating part or the second operation part, in order to expose the operation part to be operated, when the shutter plate reaches a predetermined swing angle, the plunger for the operation part to be operated is retracted by the first cam and first limit switch or the second cam and second limit switch to release the limitation of the swing of the shutter plate.

Advantageous Effects of Invention

A three-position switch operating mechanism employing the operating mechanism of the invention provides an effect in which: the shutter plate and the cams are integrally formed to allow operation without backlash in the contact operation of the limit switch by the cams; the shutter functions of both the operating parts are integrated into one shutter to allow reduction in the number of parts; and the operation of the shutter is integrated to one point to allow improvement in operability and allow any appropriate contact operating position to be set.

BRIEF DESCRIPTION OF DRAWINGS

FIGS. 5A-5D Diagrams illustrating an operation angle of the shutter plate when a disconnecting switch is operated.

FIGS. 6A-6D Diagrams illustrating an operation angle of the shutter plate when an earthing switch is operated.

DESCRIPTION OF EMBODIMENTS

Figure 1:
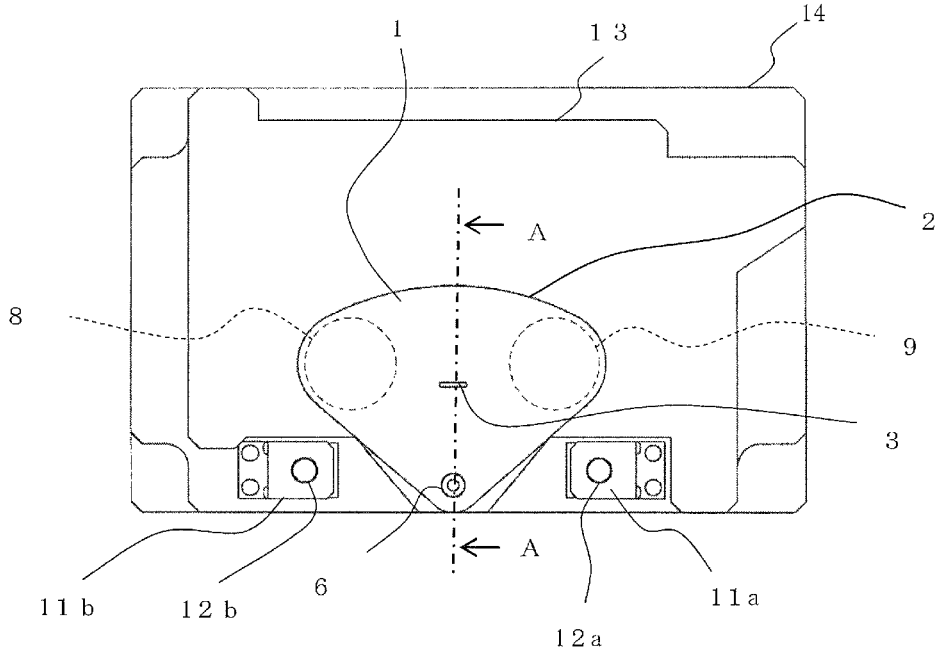
FIG. 1 A front view showing a three-position switch operating mechanism in accordance with a first embodiment of the invention.

Embodiments of the invention are described below with reference to the drawings.

Note that, through the drawings, the same reference numerals denote the same or corresponding components.

First Embodiment

Figure 2:
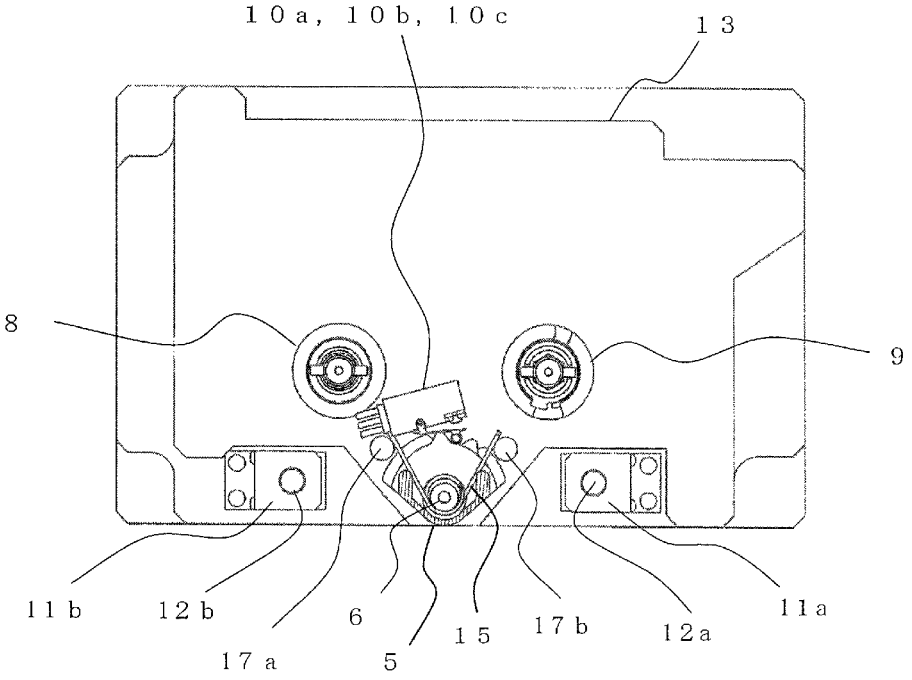
FIG. 2 A front view in which a shutter plate is removed from FIG. 1.
Figure 3:
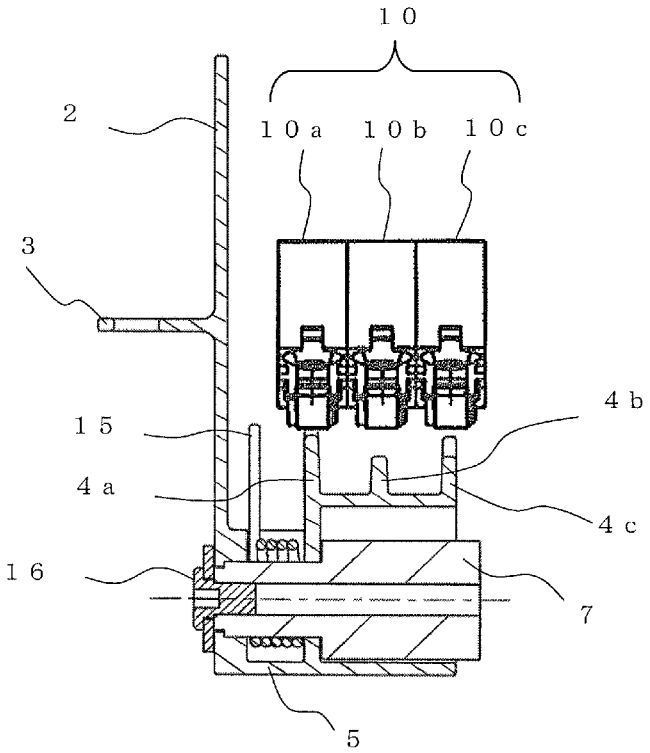
FIG. 3 A cross-sectional view taken along the line A-A in FIG. 1.

FIG. 1 is a front view showing a three-position switch operating mechanism in accordance with a first embodiment of the invention. FIG. 2 is a front view in which a shutter plate 2 is removed from FIG. 1. FIG. 3 is a cross-sectional view taken along the line A-A in FIG. 1.

Referring to FIGS. 1 to 3, a shutter mechanism 1 includes: the shutter plate 2; a lever 3; cams 4 placed in parallel to the shutter plate 2 and having individually different outer circumference shapes (hereinafter, a first cam, a second cam and a third cam are referred to as "mode switching plate 4*a*," "mode switching plate 4*b*" and "mode switching plate 4*c*," respectively); a spring retainer 5 placed between the shutter plate 2 and the mode switching plate 4*a*; a return spring 15 retained by the spring retainer 5; and the like, all of which are integrally formed of a non-magnetic metal, and an attachment part 6 is fixed to a swing shaft 7. Then, swinging the lever 3 clockwise and counterclockwise can swing the shutter plate 2 clockwise (in one direction) and counterclockwise (in reverse direction) about the swing shaft 7. When switching operation of a disconnecting switch (not shown) or an earthing switch (not shown) is not performed, the shutter 2 is placed so as to hide (cover) a first operating part (hereinafter referred to as "disconnecting switch operating part") 8 and a second operating part (hereinafter referred to as "earthing switch operating part") 9.

At this time, the swing of the shutter plate 2 is limited by plungers 12*a* and 12*b* described later.

A stationary plate 13 is a part of the mechanism body included in a three-position switch operating mechanism 14 and is mounted and fixed to a frame or the like of the three-position switch operating mechanism 14.

The stationary plate 13 has: limit switches 10 (a first limit switch 10*a*, a second limit switch 10*b* and a third limit switch 10*c*) for operating a contact depending on the swing angle of the above-described mode switching plates 4*a*, 4*b* and 4*c*; an interlock coil 11*a* for disconnecting switch; an interlock coil 11*b* for earthing switch; and the plungers 12*a* and 12*b* driven by energizing the coils 11*a* and 11*b*, respectively, placed thereon.

FIG. 5 illustrates an operation angle of the shutter plate 2 when the disconnecting switch is operated.

When the disconnecting switch is to be operated, as shown in FIG. 5(*a*), the lever 3 is swung clockwise by an angle of 8-25° to cause the mode switching plate 4*a* to close the contact of the limit switch 10*a* to energize the interlock coil 11*a* for disconnecting switch. This pulls the plunger 12*a* into the coil to release the shutter plate 2 from the interference (limitation) by the plunger 12*a* and allow the shutter plate 2 to be swung clockwise again.

When the shutter plate 2 is swung by an angle of 25-30°, the mode switching plate 4*a* opens the contact of the limit switch 10*a* to de-energize the interlock coil 11*a* for disconnecting switch, causing the plunger 12*a* to be returned.

As shown in FIG. 5(*c*), when the shutter plate 2 is swung by an angle of 30° or more, the disconnecting switch operating part 8 is completely exposed, allowing the disconnecting switch to be operated. At this time, as shown in FIG. 5(*d*), the mode switching plate 4*c* closes the contact of the limit switch 10*c*, the state of which can be indicated by configuring a circuit as shown in FIG. 7 and using a relay for detecting that the disconnecting switch is being operated.

Note that, by configuring so that the contact of the limit switch 10*a* is closed only when the shutter plate 2 is swung by an angle of 8-25°, when the interlock coil 11*a* for disconnecting switch satisfies an interlock condition that the earthing switch is in off state, the coil is prevented from being constantly energized to generate heat.

With the disconnecting switch in on state, even when the shutter plate 2 is swung counterclockwise in order to expose the earthing switch operating part 9, the electrical interlock is not unlocked at a swing angle of 8-25°, and, as shown in FIG. 6(*b*), at a swing angle of 20°, the swing is prevented by the plunger 12*b* for the interlock coil 11*b* for earthing switch.

Figure 7:
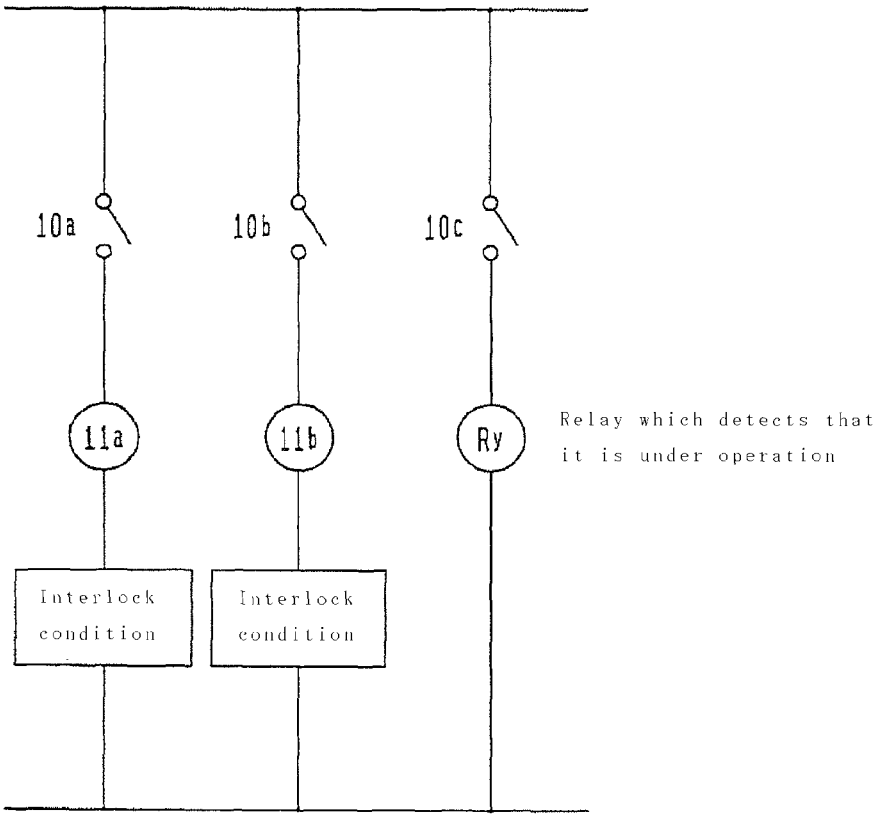
FIG. 7 An circuit diagram showing a circuit configuration example of a limit switch.

By providing a circuit shown in FIG. 7, the electrical interlock of the interlock coil 11*b* for earthing switch is configured to be locked when the corresponding interlock condition is that the disconnecting switch is in on state, and configured to be unlocked when the corresponding interlock condition is that the disconnecting switch is in off state.

FIG. 6 illustrates an operation angle of the shutter plate 2 when the earthing switch is operated.

When the earthing switch is to be operated, as shown in FIG. 6(*a*), the lever 3 is swung counterclockwise by an angle of 8-25° to cause the mode switching plate 4*b* to close the contact of the limit switch 10*b* to energize the interlock coil 11*b* for earthing switch. This pulls the plunger 12*b* into the coil to release the shutter plate 2 from the interference (limitation) by the plunger 12*b* and allow the shutter plate 2 to be swung counterclockwise again.

When the shutter plate 2 is swung by an angle of 25-30°, the mode switching plate 4*b* opens the contact of the limit switch 10*b* to de-energize the interlock coil 11*b* for disconnecting switch, causing the plunger 12*b* to be returned. When the shutter plate 2 is swung by an angle of 30° or more, the earthing switch operating part 9 is completely exposed, allowing the earthing switch to be operated. At this time, as shown in FIG. 6(*d*), the mode switching plate 4*c* closes the contact of the limit switch 10*c*, the state of which can be indicated by configuring a circuit as shown in FIG. 7 and using a relay for detecting that the earthing switch is being operated.

Note that, by configuring so that the contact of the limit switch 10*b* is closed only when the shutter plate 2 is swung by an angle of 8-25°, when the interlock coil 11*b* for earthing switch satisfies an interlock condition that the disconnecting switch is in off state, the coil is prevented from being constantly energized to generate heat.

With the earthing switch in on state, even when the shutter plate 2 is swung clockwise in order to expose the disconnecting switch operating part 8, the electrical interlock is not unlocked at a swing angle of 8-25°, and, as shown in FIG. 5(*b*), at a swing angle of 20°, the swing is prevented by the plunger 12*a* for the interlock coil 11*a* for disconnecting switch.

By providing a circuit shown in FIG. 7, the electrical interlock of the interlock coil 11*a* for disconnecting switch is configured to be locked when the corresponding interlock condition is that the earthing switch is in on state, and configured to be unlocked when the corresponding interlock condition is that the earthing switch is in off state.

According to the first embodiment, the shutter functions of the disconnecting switch operating part 8 and the earthing switch operating part 9 are integrated into the shutter mechanism 1, allowing the number of parts to be reduced. Furthermore, the operation parts of the shutter mechanism 1 is integrated to the lever 3, allowing simpler operation.

Furthermore, the shutter plate 2 is integrally formed to eliminate backlash between parts, which can improve the reliability of contact operation of the limit switches 10*a*, 10*b* and 10*c* by the mode switching plates 4*a*, 4*b* and 4*c*.

Note that the shutter plate 2 is formed of a non-magnetic metal so as not to be affected by magnetic flux from the interlock coil 11*a* for disconnecting switch or the interlock coil 11*b* for earthing switch.

A conventional shutter is configured to operate the contact by arc motion of the shutter directly coupled to a cam switch. So, in operating the contact at a predetermined earthing position by interlock, the operation angle is limited by the internal cam shape of the cam switch. Furthermore, when the cam switch cannot be used, a mode switching plate and a limit switch need to be used to operate the contact at any appropriate position, which raises problems of increase in the number of parts and backlash between parts. However, the first embodiment can solve these problems.

Second Embodiment

Figure 4:
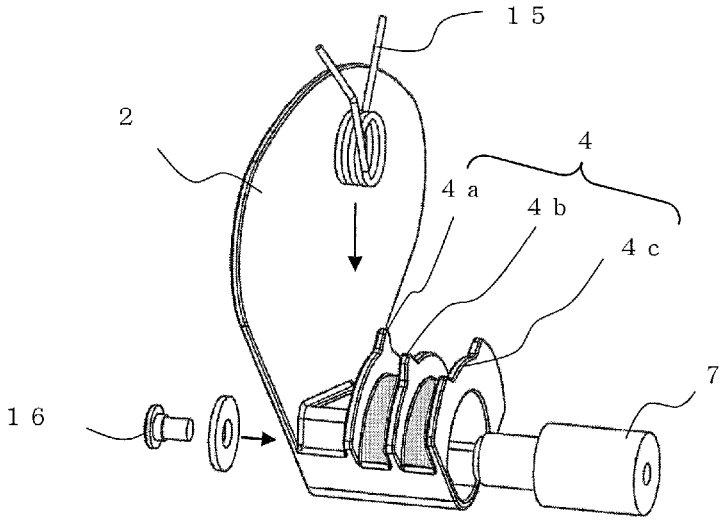
FIG. 4 An exploded perspective view of an assembled shutter mechanism.

FIG. 4 is an exploded perspective view of an assembled shutter in accordance with a second embodiment.

In FIG. 4, a return spring 15 is retained by a spring retainer 5 on a swing shaft 7, and a shutter plate 2 is fixed to the swing shaft 7 by a fixing screw 16.

When the shutter plate 2 is swung clockwise and counterclockwise, the return spring 15 is received and compressed by return spring supporting parts 17*a* and 17*b*, so, after operating the disconnecting switch or the earthing switch, the shutter plate 2 can be returned to the initial state by the return spring 15.

According to the second embodiment, the spring retainer 5 is integrally formed with and between the shutter plate 2 and a mode switching plate 4*a*, so the return spring 15 can be mounted by vertically placing the return spring 15 onto the spring retainer 5 then inserting the swing shaft 7 into an attachment part 6, which can simplify fabrication.

INDUSTRIAL APPLICABILITY

The invention is useful for providing an operating mechanism having an effect of improving operability and allowing any appropriate contact operating position to be set.

The invention claimed is:

1. An operating mechanism comprising:

a shutter plate that is swingably supported by a swing shaft held by a mechanism body, and covers both a first operating part and a second operating part placed in parallel to each other on the mechanism body; and a shutter mechanism that, in exposing the first operating part to operate the first operating part, swings the shutter plate in one direction and, in exposing the second operating part to operate the second operating part, swings the shutter plate in reverse direction, wherein the shutter mechanism comprises:

one pair of plungers for limiting or releasing the swing of the shutter plate:

first and second cams that move in conjunction with the shutter plate; and first and second limit switches that are opened and closed by the first and second cams, respectively, to control a protruding/retracting operation of the pair of plungers that are configured to be protruded and retracted with respect to the shutter plate, wherein both the plungers normally limit the swing of the shutter plate to maintain the first operating part and the second operating part covered, and wherein, in operating the first operating part or the second operation part, in order to expose the operation part to be operated, when the shutter plate reaches a predetermined swing angle, the plunger for the operation part to be operated is retracted by the first cam and first limit switch or the second cam and second limit switch to release the limitation of the swing of the shutter plate.

2. The operating mechanism according to claim 1, wherein an operating spring for returning the shutter plate to the position for covering both the operating parts is provided on the swing shaft.

3. The operating mechanism according to claim 2, wherein the plunger is protruded/retracted by an interlock coil that is energized/de-energized by opening/closing the corresponding limit switch.

4. The operating mechanism according to claim 3, wherein, when the first operating part or the second operation part is completely exposed, the interlock coil is de-energized by the first cam and first limit switch or the second cam and second limit switch.

5. The operating mechanism according to claim 1, wherein the plunger is protruded/retracted by an interlock coil that is energized/de-energized by opening/closing the corresponding limit switch.

6. The operating mechanism according to claim 5, wherein, when the first operating part or the second operation part is completely exposed, the interlock coil is de-energized by the first cam and first limit switch or the second cam and second limit switch.

7. The operating mechanism according to claim 1, wherein a third cam and a third limit switch for, when the first operating part or the second operating part is exposed, indicating that the exposed operating part is operating are provided to the shutter mechanism.

8. The operating mechanism according to 7, wherein the shutter plate and the first, second and third cams are integrally formed and fitted over the swing shaft.

* * * * *